US005291172A

United States Patent [19]

Ito et al.

[11] Patent Number: 5,291,172

[45] Date of Patent: Mar. 1, 1994

[54] NOISE ABSORBER

[75] Inventors: Fuminori Ito, Nagoya; Hiroyuki Ikeda, Musashino, both of Japan

[73] Assignee: Kitagawa Industries Co., Ltd., Japan

[21] Appl. No.: 871,892

[22] Filed: Apr. 21, 1992

[30] Foreign Application Priority Data

Jul. 18, 1991 [JP] Japan ..... 3-56196[U]

[51] Int. Cl.[5] ..... H01F 27/26

[52] U.S. Cl. ..... 336/65; 324/127; 333/12; 336/176

[58] Field of Search ..... 324/127; 174/92, 138 F; 333/81 R, 12, 243, 183; 336/174, 175, 176, 92, 233, 229, 212, 210

[56] References Cited

U.S. PATENT DOCUMENTS

| | | | |
|---|---|---|---|
| 4,825,185 | 4/1989 | Matsui | 336/92 |
| 4,882,561 | 11/1989 | Fujioka | 336/65 |
| 4,964,013 | 10/1990 | Kitagawa | 336/212 |
| 4,970,476 | 11/1990 | Kitagawa | 336/175 |
| 4,983,932 | 1/1991 | Kitagawa | 336/176 |

FOREIGN PATENT DOCUMENTS

| | | |
|---|---|---|
| 2207007 | 1/1989 | United Kingdom . |
| 2223887 | 4/1990 | United Kingdom . |

*Primary Examiner*—Thomas J. Kozma
*Attorney, Agent, or Firm*—Davis, Bujold & Streck

[57] ABSTRACT

A noise absorber provided with a fixture disposed at a flank of a body, thereby improving the positionability of the noise absorber and easy access thereto for handling. The body and the fixture are integrally connected by engaging a first engaging portion provided on the body with a second engaging portion on the fixture. When the body and the fixture are connected, the bottom of the body and the bottom surface of the fixture are at the same height, thereby coordinately supporting the noise absorber on a chassis or a printed board. Since the fixture is provided at the flank of the body on the same level, the height of the noise absorber as a whole is reduced. The noise absorber is thus advantageous for positioning in a location with limited space. Moreover, since the fixture to be handled is positioned at the flank of the body for easy access, the noise absorber of this invention can be easily fitted or disassembled.

18 Claims, 17 Drawing Sheets

NOISE ABSORBER

BACKGROUND OF THE INVENTION

This invention relates to a noise absorber for enclosing wires of electronic equipment therein to absorb electric noises generated within the equipment and to prevent noises generated outside the equipment from running through the wires into the equipment.

A conventional noise absorber surrounds an outer periphery of wires with ferrite or other magnetic material, thereby absorbing electric noises running through the wires. Such a noise absorber comprises coupling devices molded of magnetic material. The coupling devices are in the shape of a cylinder cut in half along an abutment face including the axis thereof. The coupling devices are housed in cases provided in a container made of a synthetic resin. When the container is closed, the coupling devices made of magnetic material contained within the case enclose the wires therein in order to absorb electric noises. Such a noise absorber is secured to a chassis or a printed board by engaging an engaging portion disposed at its bottom with a second engaging member on a top of a stand which is screwed onto the chassis or the substrate.

Although such a noise absorber can be fixed to a printed board and a housing, the stand of the noise absorber occupies a lot of space, thereby hampering placement of the noise absorber. Moreover, in repairing or other occasions where the noise absorber needs to be removed, the engaging portions between the stand and the noise absorber are difficult to reach since the stand is positioned at the bottom of the noise absorber. Thus, the mechanism for fixing the noise absorber needs to be further improved

SUMMARY OF THE INVENTION

Wherefore, an object of the invention is to provide a noise absorber which can be easily installed at a desired location and has improved operability.

In order to achieve the above object, a noise absorber according to the invention comprises coupling devices molded of magnetic material, a container for containing the coupling devices, and a stand or support member. Each of the coupling devices is a cylinder divided in half along an abutment face including the axis thereof so as to enclose an outer periphery of wires of electronic equipment. When combined with each other, their abutment faces are closely abutted. The container is openable by a hinge. When the container is closed, the coupling devices made of magnetic material enclose the wires, thereby absorbing electric noises running through the wires. The container is provided with a first engaging portion. The stand comprises a second engaging portion for engaging the first engaging portion, a support portion for supporting the container at a flank thereof, and a bottom face which is substantially at the same level as a bottom of the container when the first and the second engaging portions engage one another.

In the noise absorber with the structure specified above, the container and the stand are integrally combined by engaging a first engaging portion of the container and a second engaging portion of the stand. When the container and the stand are combined, a bottom surface of the container and the bottom face of the stand are substantially at the same level. The support portion of the stand supports the container at the flank. Thus, the stand is integrally connected to the flank of the container and the container can be fixed on a chassis or a printed board while it is supported by the stand. Since the stand is provided on the same level as the container, the height of the noise absorber as a whole is minimized. Thus the noise absorber is advantageous for use in a location with limited space. Moreover, since the stand is provided at the flank of the container, the stand is easily accessible for removal from the chassis or the printed board, thus facilitating disassembly of the container.

DETAILED DESCRIPTION OF THE PREFERRED EMBODIMENT

Figure 1:
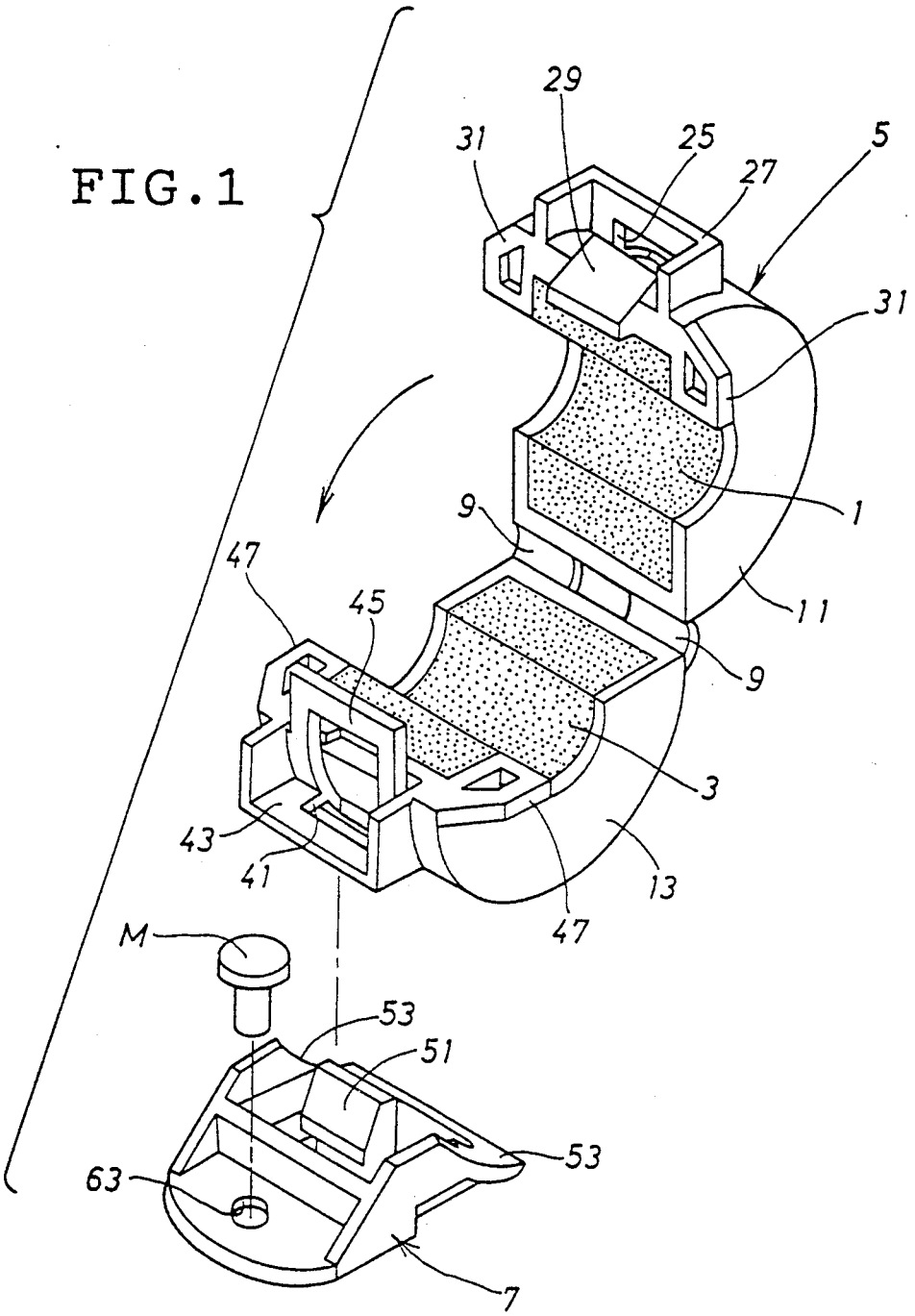
FIG. 1 is a perspective view showing the structure of a noise absorber of a first embodiment according to the present invention.

An embodiment of a noise absorber according to the present invention will now be explained hereunder referring to the drawings.

Figure 17:
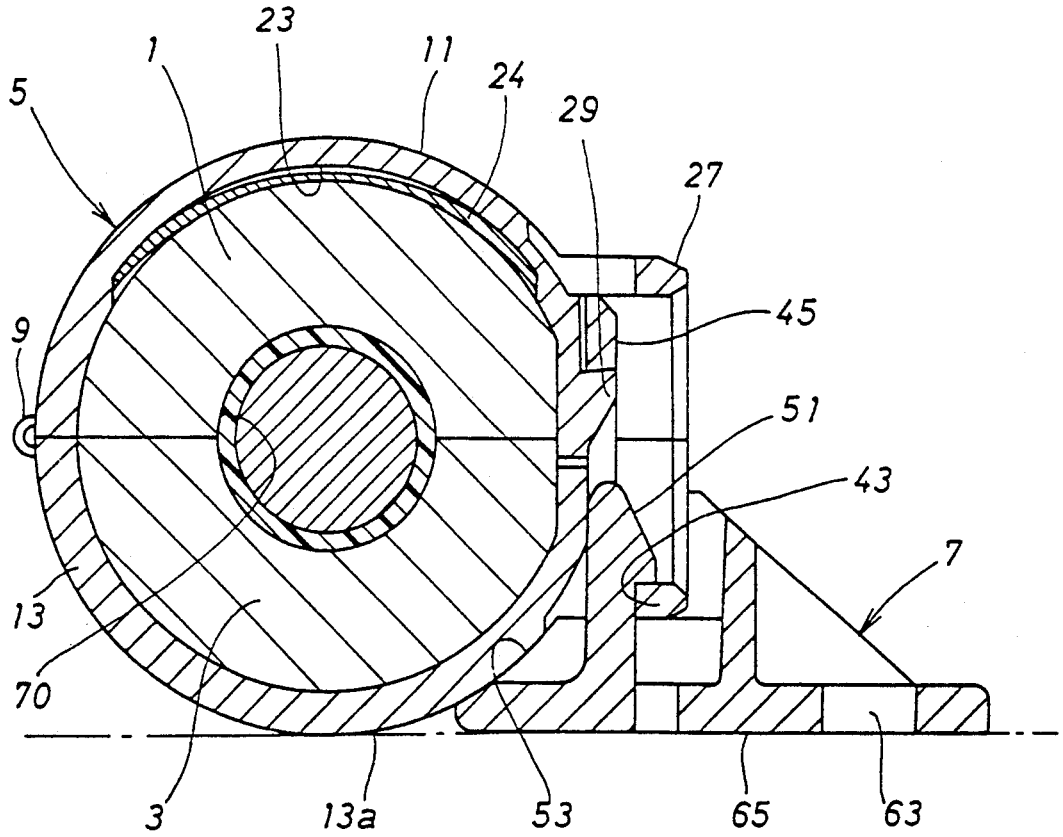
FIG. 17 is a sectional view of the noise absorber in a mounted condition.

As shown in FIG. 1, a noise absorber of the invention comprises ferrite pieces 1 and 3, a container 5 and a support member or a stand 7. Each of the coupling members or the ferrite pieces 1 and 3 is in the shape of a cylinder divided in half along abutment faces which lie in a plane defined by the axis of the cylinder so as to enclose wires when combined with one another. The ferrite pieces 1 and 3 have indentations (not shown) in their side faces for receiving a projection 15 and other protrusions of the container 5 as described later. The container 5 comprises a first upper case 11 and a second lower case 13 interconnected by a hinge 9 for housing the ferrite pieces 1 and 3, respectively. As shown in FIGS. 2 through 9, the container 5 has a projection 15 and protrusions 17, 19 and 21 on an inner peripheral surface of the upper case 11. The projection 15 engages the corresponding indentation of the ferrite piece 1, thereby supporting the ferrite piece 1 inside the upper case 11. The protrusions 17, 19 and 21 offset the allowance of the outer dimension of the ferrite piece 1. The upper case 11 is provided with a disposing space or opening 23 within which a leaf spring 24 is disposed as shown in FIG. 17. The leaf spring 24 presses or biases the ferrite piece 1 against the opposite ferrite piece 3 such that the end faces of the ferrite pieces 1 and 3 intimately abut one another. The upper case 11 is also provided with an engaging hook 29 on a first latch end for closing the container 5 and a first protective frame 27 on the same end for protecting the engaging hook 29. The protective frame 27 has an opening 25 for releasing a hook receiver 45 of the lower case 13 from the engaging hook 29 of the upper case 11. Handles 31 axially extend from both opposed sides of the latch end of the upper case 11.

Figure 2:
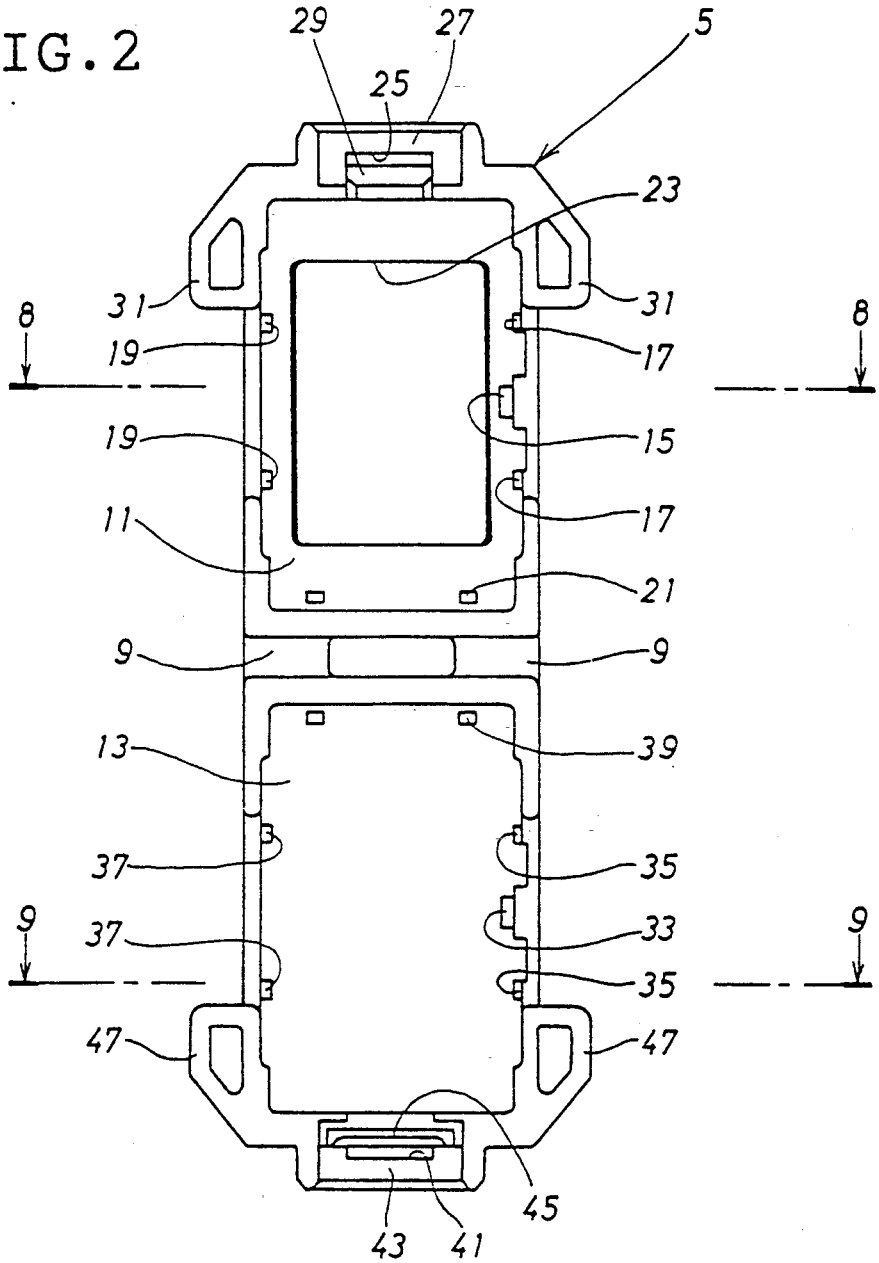
FIG. 2 is a plan view of a container of the noise absorber.
Figure 3:
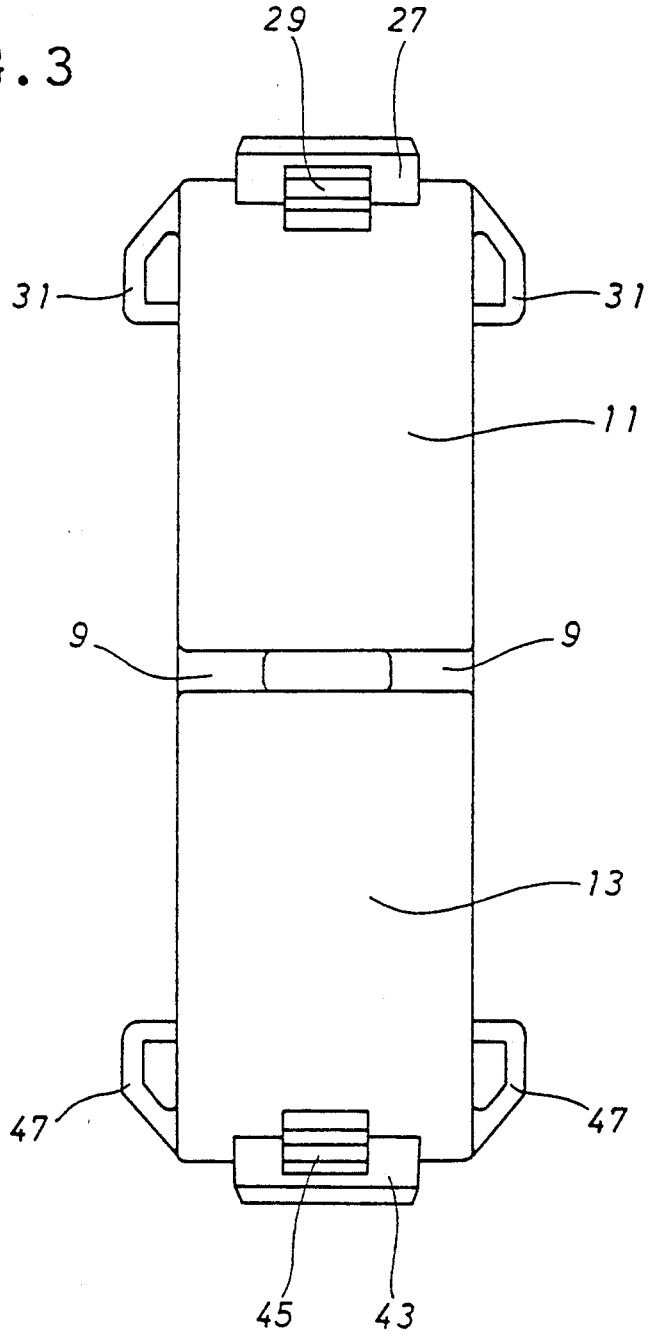
FIG. 3 is a bottom plan view of the container.
Figure 4:
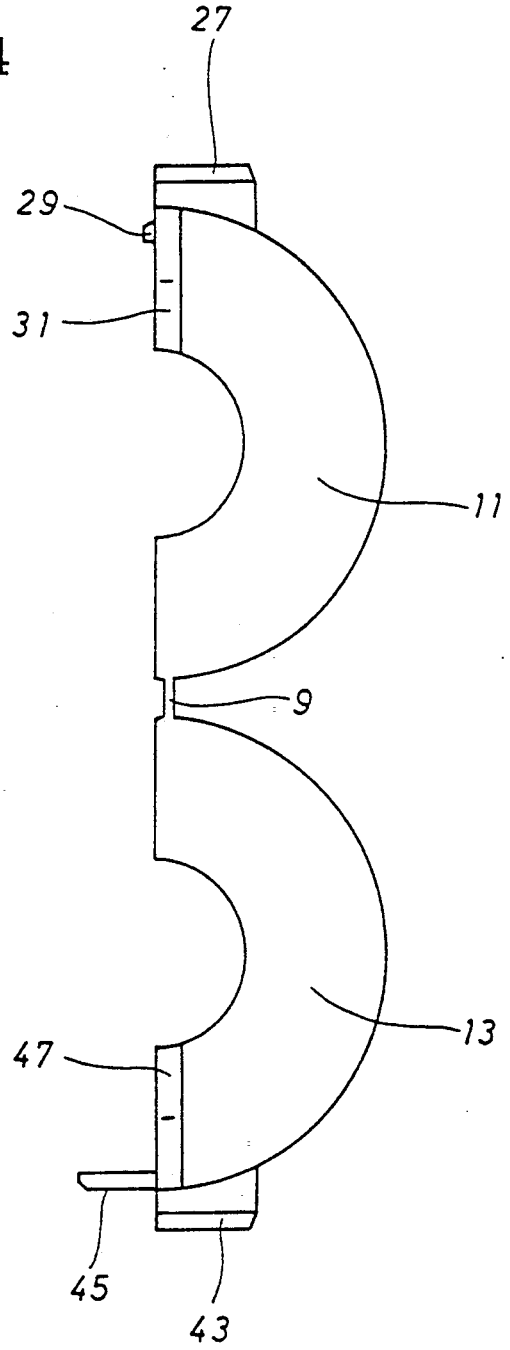
FIG. 4 is a side view of the container.
Figure 5:
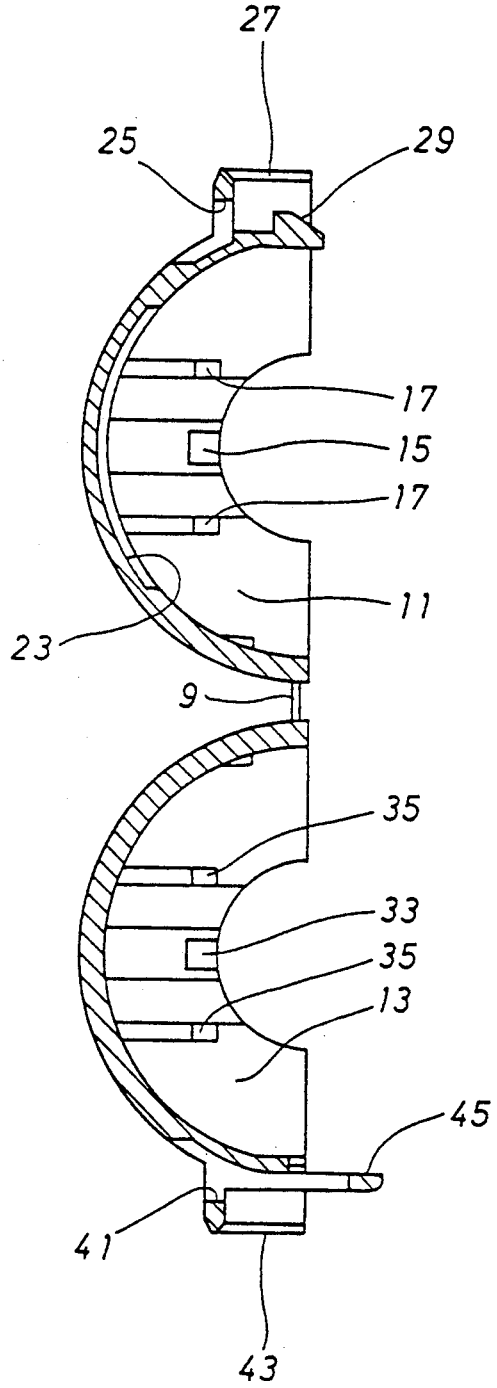
FIG. 5 is a side sectional view of the container.
Figure 6:
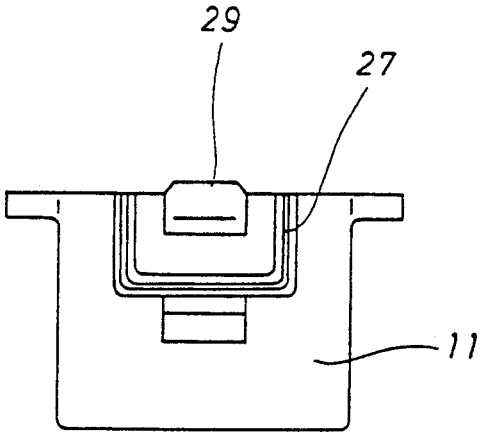
FIG. 6 is a front view of upper case of the container.
Figure 7:
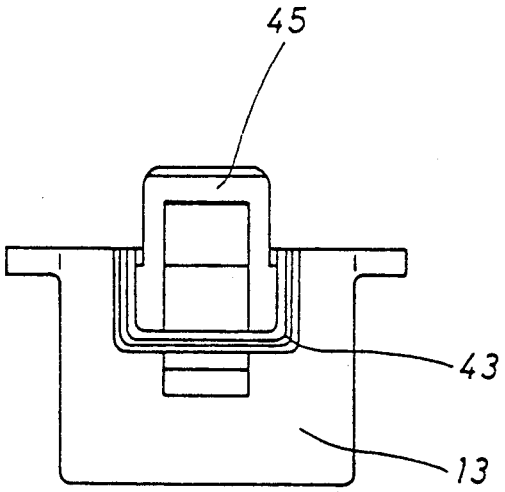
FIG. 7 is a rear view of the lower case of the container.
Figure 8:
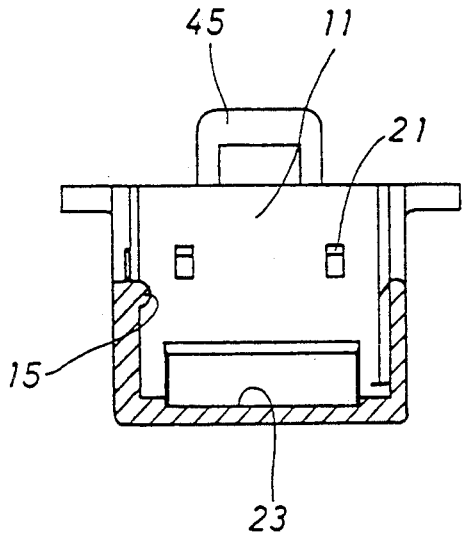
FIG. 8 is a sectional view of the container taken along the line 8—8 of FIG. 2.
Figure 9:
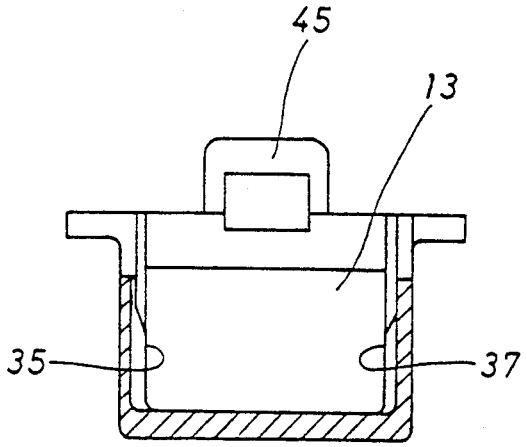
FIG. 9 is a sectional view of the container taken along the line 9—9 of FIG. 2.
Figure 10:
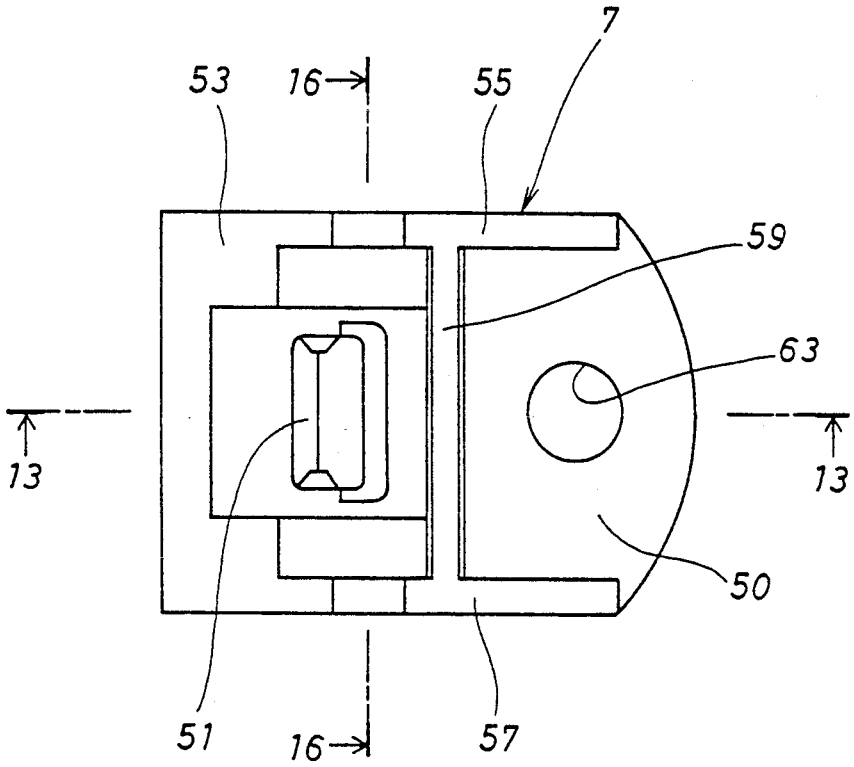
FIG. 10 is a plan view of a stand of the noise absorber
Figure 11:
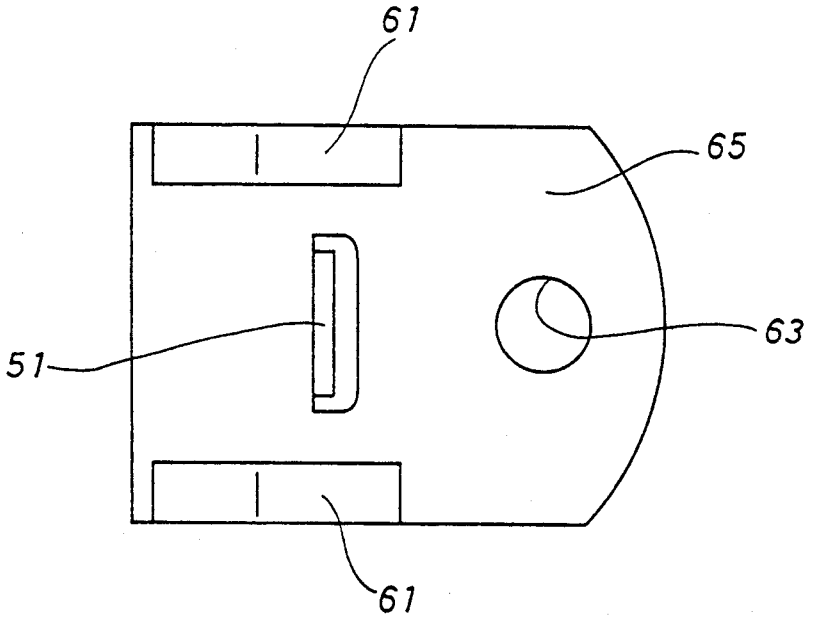
FIG. 11 is a bottom plan view of the stand.

In the same manner as the upper case 11, as shown in FIG. 2, the lower case 13 is provided with a projection 33 and protrusions 35, 37 and 39. The projection 33 engages a corresponding indentation provided in a side of the ferrite piece 3, thereby supporting the ferrite piece 3 inside the lower case 13. The protrusions 35, 37 and 39 offset the allowance of the outer dimension of the ferrite piece 3. The lower case 13 is also provided on a first latch end with a hook receiver 45 for receiving and engaging the engaging hook 29 of the upper case 11 and further, with a second protective frame 43 for protecting the hook receiver 45 and an engaging hook 51 of the stand 7. The protective frame 43 has an engaging aperture 41 for engaging the engaging hook 51 of the stand 7. Handles 47 axially extend from both opposed sides of the first latch end of the lower case 13.

Figure 12:
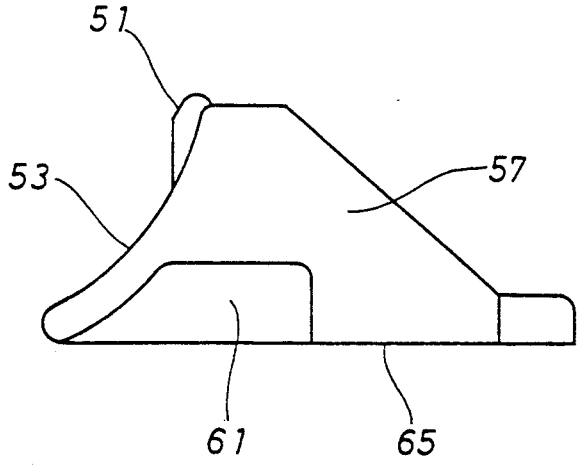
FIG. 12 is a side view of the stand.
Figure 13:
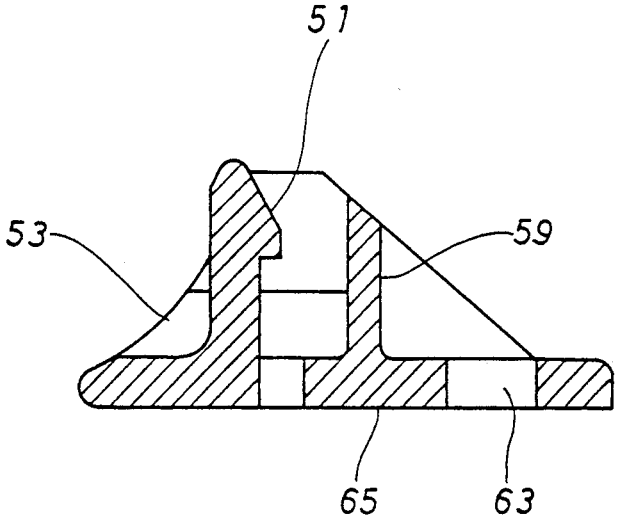
FIG. 13 is a sectional view of the stand taken along the line 13—13 of FIG. 10
Figure 14:
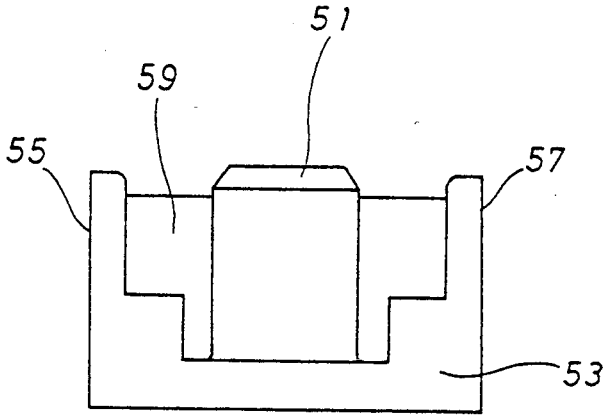
FIG. 14 is a front view of the stand.
Figure 15:
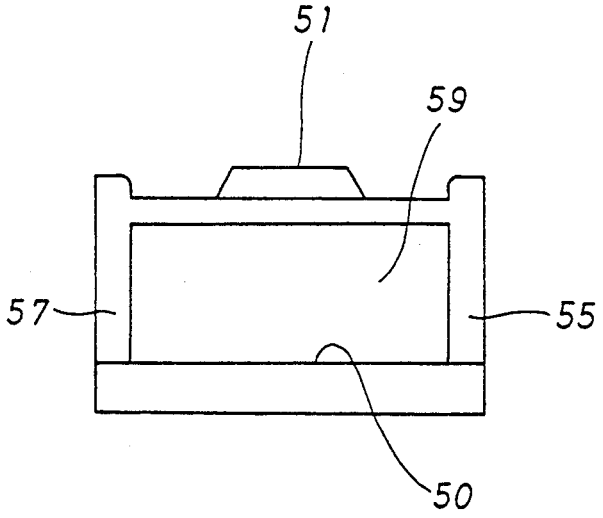
FIG. 15 is a rear view of the stand.
Figure 16:
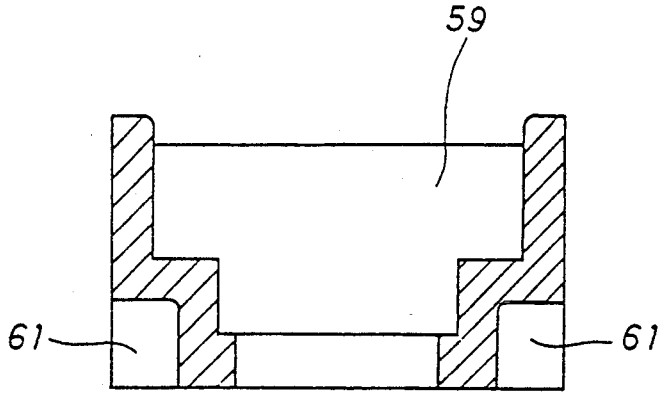
FIG. 16 is a sectional view of the stand taken along the line 16—16 of FIG. 10.

As shown in FIGS. 10 through 16, the stand 7 comprises the engaging hook 51 located at the center facing toward the front of a base 50 of the stand 7. Side walls 55 and 57 are provided on respective sides of the engaging hook 51. The side walls 55 and 57 have support surfaces 53 which have a curvature substantially corresponding to the curvature of the outer peripheral surface of the upper and lower cases 11 and 13. The side walls 55 and 57 are connected and reinforced by a connecting member or board 59 therebetween. As shown in FIG. 12, the side walls 55 and 57 are partly hollowed out to form scoops 61. A securing aperture 63 is formed in a rear portion of the base 50 to receive a fixing or securing member M, such as a rivet, for fixing the stand 7 to a chassis or a printed board. As shown in FIG. 17, a bottom surface 65 of the base 50 is substantially at the same height as a portion of a bottom surface 13*a* of the container 5 when the stand 7 is integrally connected to the container 5. Thus, the container 5 and the stand 7 are secured on the same plane while maintaining the relative positions thereof.

In operation, as shown in FIG. 17, by engaging the engaging hook 29 of the upper case 11 with the hook receiver 45 of the lower case 13, the container 5 is closed. The ferrite pieces 1 and 3 are intimately abutted on their abutment faces to form a cylinder. Wires are located at a predetermined position such that the wires are disposed in a hollow central section 70 defined by the ferrite pieces 1 and 3. Once the stand 7 has been fixed on a chassis or a printed board by the fixing member M, the container 5 is connected to the stand 7 by engaging the engaging aperture 41 of the second protective frame 43 with the engaging hook 51 of the stand 7. The container 5 can be closed either before or after connection to the stand 7. The container 5 may be connected to the stand 7, by engaging the engaging aperture 41 with the engaging hook 51, prior to fixing the stand 7 on the chassis or the printed board by inserting fixing member M in the aperture 63.

When the noise absorber, with the container 5 and the stand 7 integrally connected, is mounted to the chassis or a substratum, the bottom surface 65 of the stand 7 and the bottom surface 13*a* of the container 5 are at the same height. The support surfaces 53 of the stand 7 cover a flank support portion of the container 5. Since the stand 7 is contiguous to the flank support portion of the container 5, the support surfaces 53 and the bottom surface 13*a* of the container 5 cooperate such that container 5 is secured to the chassis or the printed board. Moreover, since the stand 7 is provided at the flank support portion of the container 5 without elevating the container 5, the height of the noise absorber as a whole is reduced. Therefore, the noise absorber can be mounted in a location with limited space. Further, since the stand 7 is provided at the flank support portion of the container 5, the noise absorber can be easily disassembled for repairing or other occasions by removing the stand 7 from the chassis or the printed board.

The invention has been described above with reference to a preferred embodiment shown in the drawings. Modifications and alterations may become apparent to one skilled in the art upon reading and understanding the specification. Despite the use of the one embodiment for illustration purposes, it is intended to include all such modifications and alterations within the scope and the spirit of the appended claims.

In this spirit, it should also be noted that in the embodiments as shown and described, the bottom surface 65 of the stand 7 and the bottom surface 13*a* of the container 5 are substantially at the same height. However, the noise absorber is also advantageous even when the container 5 is slightly larger making the level between the bottom surface 65 and the bottom surface 13*a* a little different. In this case, when the stand 7 is fixed to a chassis by the fixing member M, the stand 7 deflects, thus forcing the stand 7 and the container 5 to be firmly secured to the chassis and preventing backlash.

Wherefore having described the present invention, what is claimed is:

1. A noise absorber for absorbing electric noise in a wire, said noise absorber comprising:

a coupling member molded of magnetic material and being in the shape of a cylinder, said coupling member being divided in half along a longitudinal axis thereof to form a pair of substantially identical mating coupling members which, when combined with one another, enclose the wire;

a container comprising first and second cases each containing one of said pair of coupling members therein, said first and second cases being hinged to one another by hinge means located adjacent a second end thereof to facilitate pivotable opening and closing of said container, and said second case having a first engaging portion; and a support member, for securing said container to a desired surface, comprising a bottom surface for engaging the desired surface, means for securing said support member to the desired surface, a second engaging portion positioned remote from said bottom surface located to engage said first engaging portion and secure said container to the support member, and flank support means for supporting an exterior flank portion of said container, wherein said first and second engaging portions and said flank support means are positioned such that at least a portion of said container substantially lies in a plane defined by said bottom surface of said support member when said first and second engaging portions engage one another.

2. A noise absorber according to claim 1, wherein said first and second cases have means adjacent first ends thereof for releasably securing said container in the closed position.

3. A noise absorber according to claim 1, wherein an inner peripheral surface of said first and second cases is provided with at least one projection and an exterior surface of said pair of coupling means is provided with at least one indentation located and shaped to receive said projection and secure said coupling members within the respective first and second cases.

4. A noise absorber according to claim 3, wherein said first case is provided with an opening accommodating a leaf spring which is disposed to bias said coupling member supported in said first case toward the other coupling member when said container is in the closed position.

5. A noise absorber according to claim 2, wherein said inner peripheral surface of said first and second cases is provided with protrusions for engaging an exterior surface of said coupling member.

6. A noise absorber according to claim 2, wherein said means for releasably securing said container in the closed position comprising an engaging hook disposed adjacent said first end of said first case and a hook receiver disposed adjacent said first end of said second case, and said engaging hook and said hook receiver are located to engage releasably one another for maintaining said container in the closed position.

7. A noise absorber according to claim 6, wherein a protective frame is located adjacent said first end of said first case and positioned to shield said engaging hook, and said first protective frame is provided with an opening to facilitate disengagement of said engaging hook from said hook receiver, as desired.

8. A noise absorber according to claim 7, wherein each of said first and second cases have a pair of opposed handles located adjacent said first end.

9. A noise absorber according to claim 8, wherein a second protective frame is located adjacent said first end of said second case to shield said hook receiver, and said first engaging portion, for engaging said second engaging portion of said support member, is formed in said second protective frame.

10. A noise absorber according to claim 9, wherein said first engaging portion is an aperture and said second engaging portion is an engaging hook shaped to engage with said engaging aperture.

11. A noise absorber according to claim 10, wherein said support member has a top surface carrying said engaging hook and said engaging hook is facing toward a first edge of said support member.

12. A noise absorber according to claim 11, wherein said flank support means comprises first and second side walls which have support surfaces with curvature substantially corresponding to a curvature of an exterior peripheral surface of said first and second cases.

13. A noise absorber according to claim 12, wherein a connecting member interconnects and reinforces said first and second side walls.

14. A noise absorber according to claim 13, wherein said side walls have a portion, adjacent said bottom surface, which is hollowed out to form opposed scoops.

15. A noise absorber according to claim 14, wherein said means for securing said support member comprises a securing aperture, located adjacent a second edge of said support member, for receiving a securing member.

16. A noise absorber according to claim 15, wherein said securing member is a rivet.

17. A noise absorber according to claim 13, wherein said second protective frame is shaped to be closely received by said first and second side walls and said connecting member.

18. A noise absorber according to claim 1, wherein said first case is pivotable to the open position even when said first and second engaging portions are engaged with one other.

* * * * *